US005732944A

United States Patent [19]

Mayer

[11] Patent Number: 5,732,944

[45] Date of Patent: Mar. 31, 1998

[54] PROCESS AND DEVICE FOR THE CORRECTLY POSITIONED TANSFER OF FOLDED SIGNATURES IN FOLDERS

[75] Inventor: Hans Günther Mayer, Frankenthal, Germany

[73] Assignee: Koenig & Bauer-Albert Aktiengesellschaft, Wurzburg, Germany

[21] Appl. No.: 824,181

[22] PCT Filed: Apr. 28, 1994

[86] PCT No.: PCT/DE94/00471

§ 371 Date: Oct. 27, 1995

§ 102(e) Date: Oct. 27, 1995

[87] PCT Pub. No.: WO94/25383

PCT Pub. Date: Nov. 10, 1994

Related U.S. Application Data

[63] Continuation of Ser. No. 532,829, Oct. 27, 1995, abandoned.

[30] Foreign Application Priority Data

Apr. 28, 1993 [DE] Germany ..... 43 13 942.6

[51] Int. Cl.[6] ..... B65H 7/02

[52] U.S. Cl. ..... 271/265.01; 271/277; 271/176; 198/459.8; 198/571; 198/576; 198/577

[58] Field of Search ..... 271/176, 265.01, 271/265.02, 270, 276, 277, 275; 198/459.8, 571, 575.577

[56] References Cited

U.S. PATENT DOCUMENTS

| | | | |
|---|---|---|---|
| 4,244,565 | 1/1981 | Geier | 271/176 |
| 4,320,894 | 3/1982 | Reist et al. | 271/277 |
| 4,333,559 | 6/1982 | Reist | 271/277 X |
| 4,458,893 | 7/1984 | Ruh | 271/277 |
| 4,770,405 | 9/1988 | Fukashima et al. | 271/176 |
| 4,986,526 | 1/1991 | Dastin | 271/277 X |
| 5,103,733 | 4/1992 | Drapatsky et al. | 271/176 X |
| 5,366,217 | 11/1994 | Tokuno et al. | 271/176 |

FOREIGN PATENT DOCUMENTS

| | | | |
|---|---|---|---|
| 1 230 811 | 12/1966 | Germany . | |
| 30 49 595 | 7/1982 | Germany . | |
| 35 34 157 | 4/1987 | Germany . | |
| 38 29 353 | 6/1989 | Germany . | |
| 218355 | 9/1987 | Japan | 271/176 |
| 2168687 | 6/1986 | United Kingdom | 271/176 |

*Primary Examiner*—Boris Milef
*Attorney, Agent, or Firm*—Jones, Tullar & Cooper, P.C.

[57] ABSTRACT

The actual position of a leading edge of a transversely folded signature is detected. This actual position detection event is used to trigger an instantaneous measurement of the actual angular position of the gripper system used for receiving the signature. If the leading edge of the signature is predicted to arrive at the gripper system of the receiving cylinder at other than the appropriate time, the speed of the receiving cylinder is corrected.

3 Claims, 6 Drawing Sheets

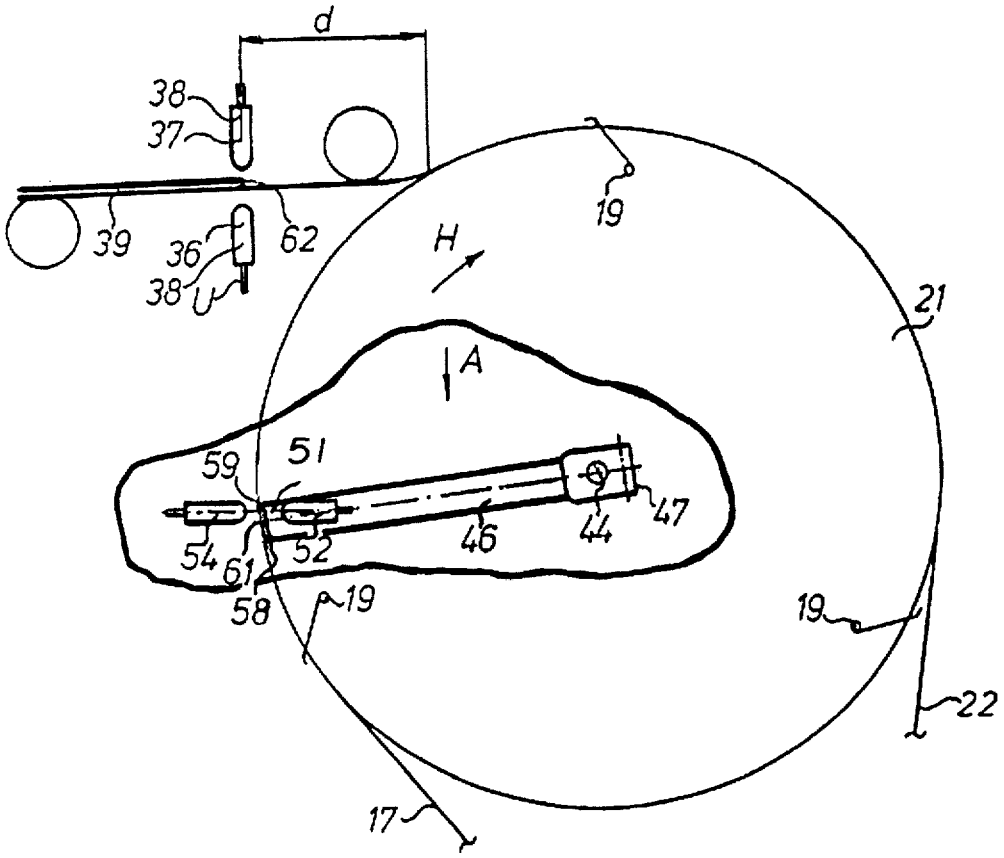
Fig.2.1
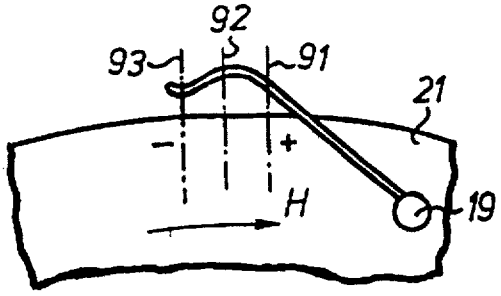
Fig.2.2
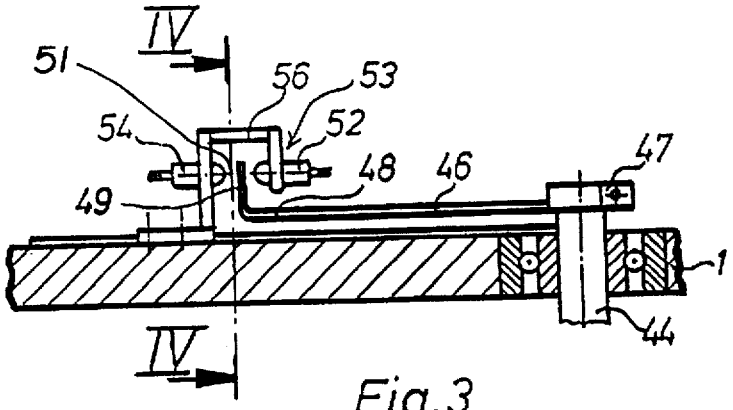
Fig.3

PROCESS AND DEVICE FOR THE CORRECTLY POSITIONED TANSFER OF FOLDED SIGNATURES IN FOLDERS

This application is a continuation of application Ser. No. 08/532,829, filed Oct. 27, 1995 now abandoned.

FIELD OF THE INVENTION

The invention relates to a process and device for the correctly positioned transfer of transversely folded signatures in folding apparatus for rotary printing presses.

DESCRIPTION OF THE PRIOR ART

A belt segment for conveying and for slowing down folded products between two successive stations of a folding apparatus is known from DE 30 49 595 A1. This device consists of at least two successive sections driven at stepped speeds in respect to each other, and each respectively having an upper and a lower belt set with several belts respectively disposed parallel with each other. A delay segment of this type can be disposed between a folding jaw cylinder and a gripper cylinder.

After a paper web train has been transversely cut into individual signatures, it is generally known to speed up the signatures by means of a belt guidance system in such a way that they can be gripped, for example by the gripper systems of, for example, a collecting cylinder adjustable to various formats. This applies in particular in connection with collecting cylinders adjustable to formats of signatures with a minimum format length.

A high silicon proportion of the surface of the paper and therefore a smooth surface of the folded product can lead to unsatisfactory acceleration or deceleration during speed-up of folded or unfolded signatures, hereinafter always referred to as signatures, as well as during slow-down of signatures. In case of an unsatisfactory acceleration of the signature, it is not sufficiently gripped by the gripper system, so that the signature can become lost. In case of an unsatisfactory deceleration, the signature penetrates so deeply into the gripper system because of its forces of inertia that no release from the gripper system takes place. Both mentioned disadvantages can result in undesired plugging of the folding apparatus. The reverse case can also occur wherein because of a high ink portion of the signatures and therefore their rough surface, either too great acceleration or too great deceleration takes place. These effects are also disadvantageous in the same way and result in plugging. The mentioned effects are the more increased the bulkier the signature, for example in case of deceleration of a signature from a multiply collected production.

A device for preventing plugging of the folding apparatus on printing presses is known from DE-PS 12 30 811, wherein a cutter for cutting off the running paper web is activated by the triggering of a contact in case of piling up or lack of pieces, and wherein the press is stopped. A photoelectric cell is provided between the folding jaw cylinder and the paddle wheel and a pulse generator is provided on the folding jaw cylinder, which is controlled as a function of the press speed, wherein both are connected with a comparison and control device which triggers the cutting of the paper web and switching off the press.

The disadvantage of this device is that the press is switched of in case of inexact positioning of folded signatures.

SUMMARY OF THE INVENTION

It is the object of the invention to provide a process and a device for the correctly positioned transfer of folded signatures which undergo a speed change between two successive stations of a folding apparatus, which is independent of a defined surface property or a defined mass of the folded signatures.

In accordance with the invention the object is attained by conveying the folded signatures from a first folding jaw cylinder to the following folding jaw cylinder by means of a belt guidance system. The actual angular position of a gripper system of a gripper cylinder intended for accepting a preselected signature in respect to a set angular position of the gripper system at a time is determined at this same time. A leading transverse fold edge of one preselected signature out of the regular succession of folded signatures has its position determined. The detected instantaneous angular position of the gripper system is compared with the set angular position. An electrical difference value signal is formed in this way. This valve signal is converted in an electronic control unit into a set value that is used for accomplishing the circumferential angle displacement of the gripper cylinder in response to the detected position of the fold edge of the preselected folded signature.

The following advantages in particular are achieved by means of the invention: by means of the invention it has become possible to correct the position of the signatures after passing through belt guidance systems immediately after incorrect positioning appears, without cutting of the paper web or stoppage of the press being necessary.

DESCRIPTION OF THE DRAWINGS

The invention will be described in detail below by means of several exemplary embodiments. The associated drawings show in.

DESCRIPTION OF THE PREFERRED EMBODIMENTS

Figure 1:
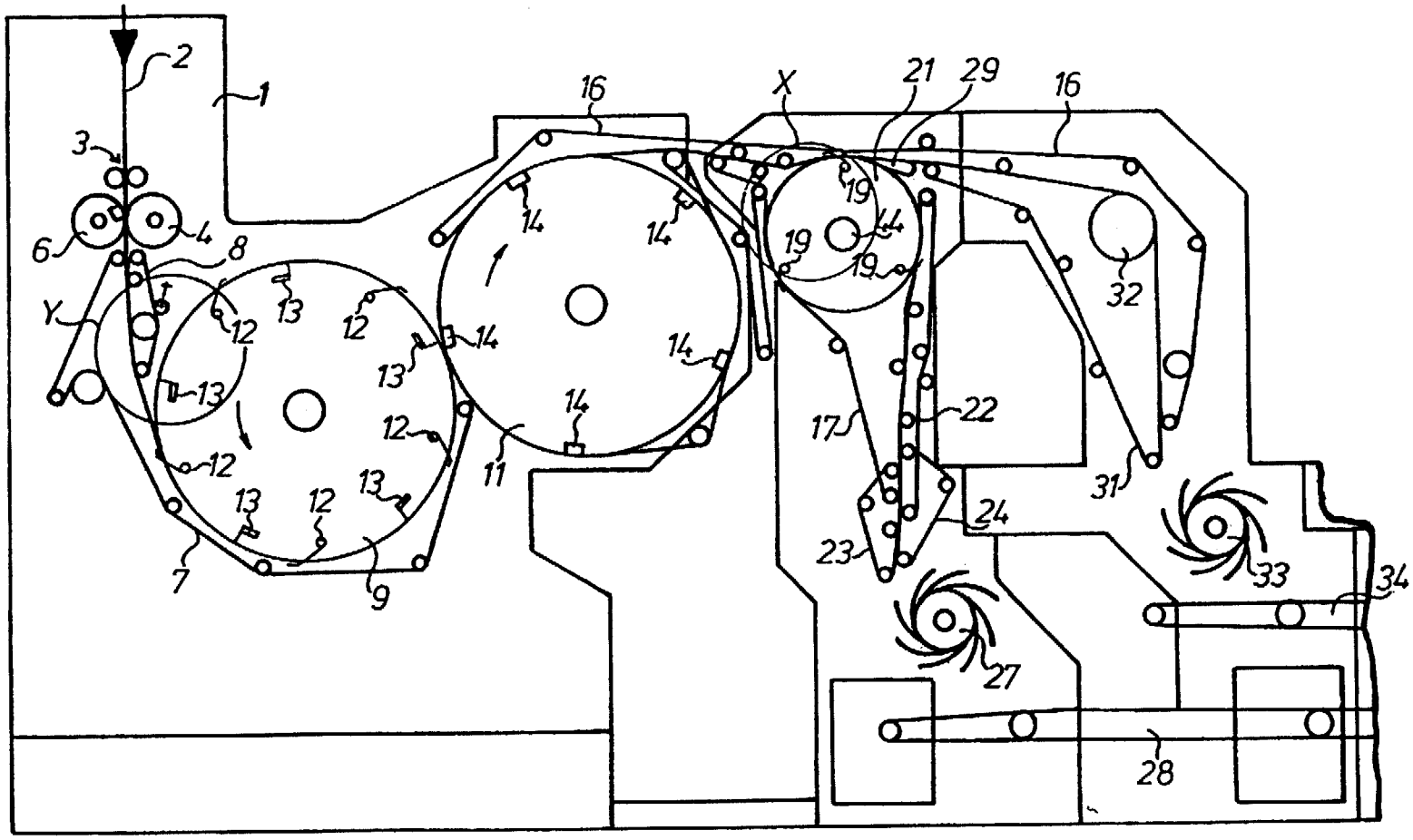
FIG. 1, a schematic lateral view of a folding apparatus with a device for the correctly positioned transfer of signatures, FIG. 2.1, a detail X in FIG. 1, FIG. 2.2, an enlarged representation of a gripper of a gripper system in FIG. 2.1, FIG. 3, a view A in FIG. 2.1, FIG. 4, a section IV—IV in FIG. 3 in an enlarged representation, FIG. 5, a block circuit diagram of a device for positioning, FIG. 6, a detail Y in FIG. 1, FIG. 7, a diagram with the representation of signals from a second evaluation unit, FIG. 8, a diagram with the representation of signals from a first evaluation unit and, FIG. 9, a schematic representation of the control of a device in accordance with the invention in a further exemplary embodiment.
Figure 4:
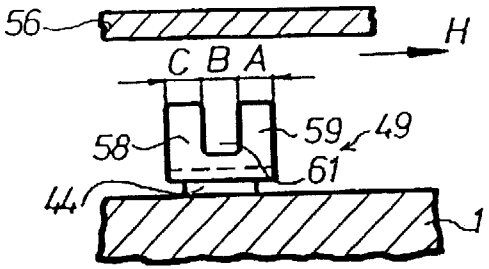

The folding apparatus shown in FIG. 1 has two lateral walls arranged parallel with each other for receiving cylinders, of which only one lateral wall is shown and identified by 1. A paper web train 2 runs through a drawing roller pair 3 and then through a transverse cutting device consisting of a transverse cutting cylinder 4 and a cutting groove cylinder 6. The signatures, not shown, which have been cut by the transverse cutting device 4, 6 are accelerated between two known belt guidance systems 7, 8, of which the second belt guidance system 8 extends up to the periphery of a following five-part collecting cylinder 9, and the first belt guidance system 7 rests against the circumference of the collecting cylinder 9 and extends up to a five-part folding jaw cylinder 11. On its circumference, the collecting cylinder 9 has five gripper systems, respectively disposed at equal distances on its circumference and identified by 12 and known per se, and also five folding blade systems, known per se and identified by 13.

Five folding jaw systems 14, known per se, are distributed at equal distances on the circumference of the folding jaw cylinder 11. Following the making of the first transverse fold, a folded signature 39 (FIG. 2.1) is created by means of the effect of the folding blade systems 13 of the collecting cylinder 9 on the folding jaw systems 14 of the folding jaw cylinder 11 and it rests on both the circumference or the surface of the folding jaw cylinder 11 and a belt guidance system 16. By means of the belt guidance system 16 and a further belt guidance system 17 the folded signature 39 (FIG. 2.1) is transferred to a three-part gripper cylinder 21 provided with three gripper systems 19, which conveys the folded signatures 39 between belt guidance systems 17, 22 and 23, 24, extending parallel with each other, to a first paddle wheel 27 with a first transverse fold delivery 28. The folded signatures 39 can alternatively be conveyed by means of a shunt 29 to a second paddle wheel 33 and a second transverse fold delivery 34 via the belt guidance systems 16 continuing over a guide roller 32 with a belt guidance system 31 extending parallel with it.

FIG. 2.1 shows the detail X in FIG. 1 with a lateral view of a gripper cylinder 21 and without the belt guidance system. A first position detection device or photoelectric barrier or gate 38, fixed on the frame and consisting of a transmitter 36 and a receiver 37, which detects the time of the arrival of a transverse fold edge 62 of a folded signature 39 moved in the production direction H, is disposed in front of the intake of the gripper cylinder 21, which runs in the clockwise direction in the production direction H. This photoelectric barrier or gate 38 is disposed fixed on the lateral frame at a distance d in respect to the periphery of the gripper cylinder 21, so that the signatures 39 are transferred, extending approximately horizontally between the belt guidance systems, to the gripper systems 19 after their conveyance. The distance d corresponds to approximately half the length of a signature 39 (FIG. 2.1). Furthermore, a one-armed lever 46 is fastened with its first end 47 on a shaft journal 44 of the gripper cylinder 21 in a frictionally and interlockingly connected manner, extends parallel with the side frame 1, and rotates with the shaft journal 44. On its second end 48, the lever 46 has a fork-shaped lug 49 which is bent at right angles, points in a direction away from the frame and cylinder and moves on a circular path having the same or approximately the same diameter as the gripper cylinder 21.

In the course of this circular movement, the lug 49 disrupts a light beam 51 coming from a transmitter 52 of a second position detector device or photoelectric barrier or gate 53 and impinging on a receiver 54. The transmitter 52 and the receiver 54 are fixed in place by means of a bearing bracket 56 on the side of the lateral frame 1 away from the cylinder, so that the light beam 51 extends parallel with the side frame 1. The device consisting of the lug 49 and the photoelectric barrier 53 is identified as the second position detection device.

Figure 7:
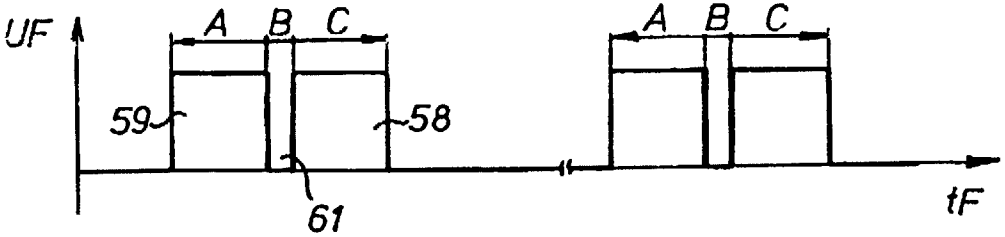
Figure 8:
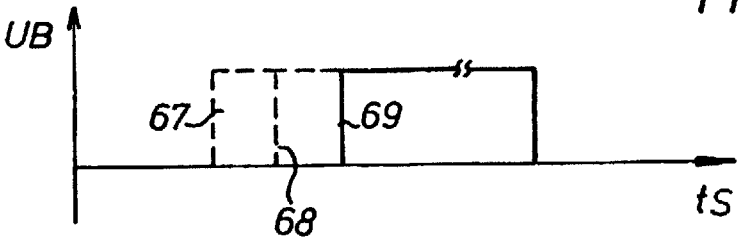

The position of the gripper cylinder 21 is scanned by means of this lug 49. The lug 49 moves on the circular path mentioned with the same diameter as the gripper cylinder 21. Scanning of the lug 49 is performed by means of the photoelectric barrier or gate 53. The position of the transverse fold edge 62 of the sheet 39 is also scanned by means of the mentioned photoelectric barrier 38 of the same construction as in the case of the lug detection. The control now has two signals available, a lug signal $U_F$ and a sheet signal $U_B$ (FIGS. 7, 8).

A release of the device is provided by means of a keyboard or an input 71 when the appropriate size of the rpm of the press is present. A signal $U_B$ is generated by means of the first position detection device 38 at a time $t_S$ 67, 68 or 69 (FIG. 8) and sent to an evaluation device 43 with a memory with the time$_s$, depending on the time the transverse fold edge 62 of the folded signature 39 has passed the photoelectric barrier 38. A signal $U_F$ is also generated by means of the second position detection device 49, 53 in an area A (generated by the leg 59 of the lug 49), in an area B (generated by the slit 61 of the lug 49) or in the area C (generated by the leg 58 of the lug 49), so that a chronological comparison of both signals $U_B$, $U_F$ in the evaluation device 43 provides information as to whether the transverse fold edge 62 of the folded signature 39 is too early (area A), too late (area C) or in the correct position (area B, FIG. 7). If the sheet signals 67 to 69 are outside of the area A to C (this can be determined by drawing a vertical line between the two diagrams in FIGS. 7 and 8), no adjustment takes place. If the sheet signal 67, "folded signature too early" (shown in dashed lines in FIG. 8) is in the area A, a high signal of a length of one second per passage of the lug 49 is present. The device acts analogously if there is a sheet signal 69, "folded signature too late" in area C (shown in solid lines in FIG. 8). Depending on whether the signature 39 is too early (signal 67, area A) or too late (signal 69, area C, FIGS. 7 and 8), the voltage signals $U_B$ and $U_F$ at the times $t_S$ and $t_F$ are compared with each other in the evaluation unit 43. In this case $U_B$ is the set value and $U_F$ the actual value. Depending on whether the time difference of $t_S$ minus $t_F$ is positive or negative, an appropriate signal is triggered via a Schmitt trigger 72 and an output amplifier 64, which activates a motor in a motor-gear unit 63. This motor superimposes its difference rpm on the main motor of the gripper cylinder 21 via its gear unit in order to bring the time difference $t_S$ minus $t_F$ to zero, i.e. the grippers 19 then grasp the folded signatures 39 at the moment they are in the right position.

The gear of the motor-gear unit 63 can consist of a harmonic-drive gear or of a spiral-geared drive gear wheel which can be displaced in the axial direction by means of a threaded spindle and a servo motor and which is frictionally and interlockingly connected with a gear wheel which meshes with a drive gear wheel of the gripper cylinder 21. A potentiometer 66 reports the respective position of the gripper cylinder 21. All elements shown in FIG. 5 i.e. 37, 42, 43; 54, 57, 43, 72, 64, 63, 66, 43, 71 are connected by means of electrical conductors not identified further.

Signals of the detection units 38; 49, 53 are evaluated once per rotation of the gripper cylinder 21 and, if required, rpm changes are performed. It is recommended to switch on the above mentioned position adjustment for the signatures only at a defined press rpm in order to prevent false reports, for example during the start-up of the press.

In the course of continuing soiling of the transmitters 36, 52 and the receivers 37, 54 of the photoelectric barriers 38, 53, the signals available to the receivers 37, 54 become smaller. Starting with a defined degree of soiling, the evaluation unit 43 is provided with a separate signal in order to prevent an interruption which can be expected because of this. It is possible, for example, to dispose compressed air nozzles in the vicinity of the transmitters 36, 52 and the receivers 37, 54 and to switch them on for removing the dirt.

Figure 6:
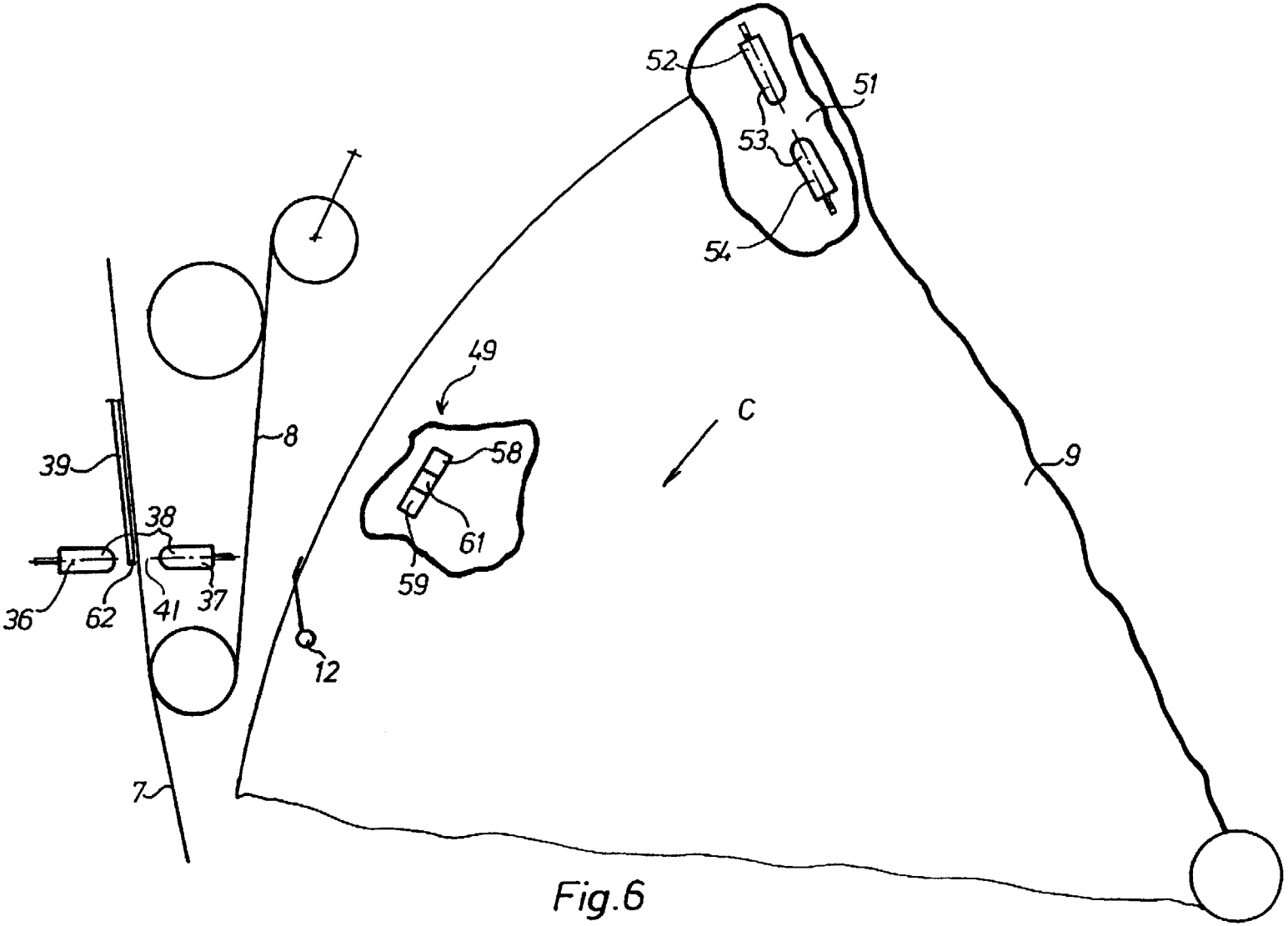

A detail Y in FIG. 1 is shown in a second exemplary embodiment in FIG. 6 with the arrangement of the device in the inlet of the signatures 39 between the belt guidance system 7, 8 leading to the collecting cylinder 9. For the sake of simplicity, the elements used were provided with the same part numbers as the elements or parts used in the first exemplary embodiment. Analogously to FIG. 2.1, a first position detector or photoelectric barrier or gate 38, fixed on the frame and consisting of a transmitter 36 and receiver 37, is disposed slightly ahead of the inlet of the collecting cylinder 9, and signals the arrival of a transverse fold edge 62 of a signature 39 to the evaluation unit 43 with its light beam 41 and stores it in the memory of the evaluating unit 43. A fork-shaped lug 49 pointing in the axial direction with legs 58, 59, which are arranged parallel with each other and extend in the axial direction, and with a slit 61 disposed between them is attached fixed on the cylinder at the front side of the collecting cylinder 9 and in the immediate vicinity of its periphery.

Figure 5:
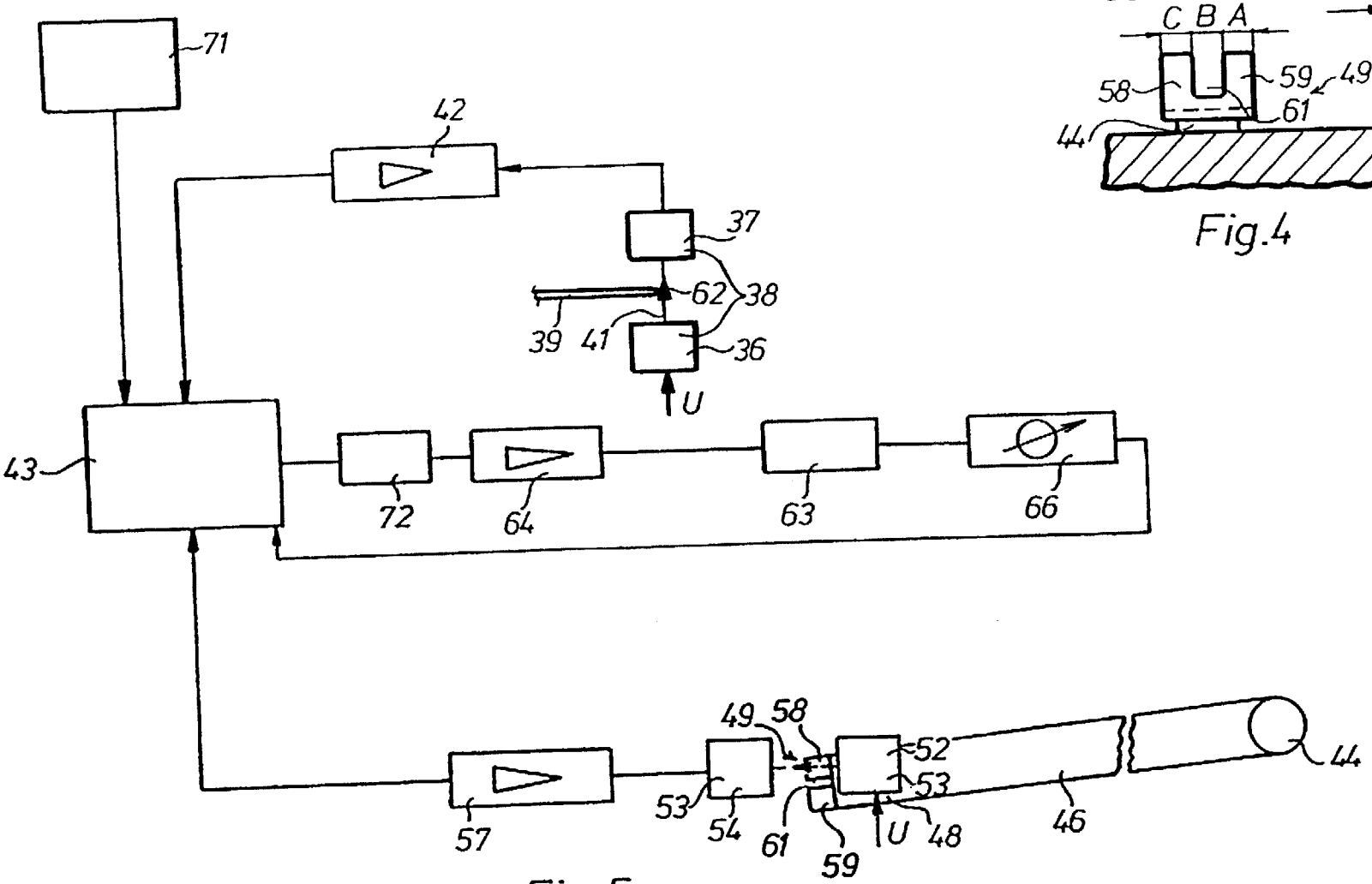

During each rotation of the collecting cylinder 9, this lug 49 fixed on the cylinder interrupts a light beam 51 coming from a transmitter 52 of a second position detector or photoelectric barrier or gate 53 fixed on the frame and impinging on a receiver 54. The signals from both photoelectric barriers or gate 38, 53 are compared in respect to their time difference (FIG. 5) in an evaluation unit 43, as already shown in the first exemplary embodiment. If in the course of entering into the gripper system 12 of the collecting cylinder 9 chronological deviations should be found, a motor-gear unit 63 is brought into engagement with the drive of the transverse cutting device 4, 6 via the evaluation unit 43, as represented in FIG. 5, in order to provide synchronization between the gripper system 12 of the collecting cylinder 9 and the signature 39 entering the photoelectric barrier 38 by means of rotating the transverse cutting cylinder 4 and the cutting groove cylinder 6.

For determining the position of a front edge 62 of a folded signature 39, it is furthermore possible to respectively fix a first position detector or photoelectric barrier or gate 38 on the frame at the outlet of the belt guidance systems 23, 24 or 31, 16 which end above the paddle wheels 27, 33. A second position detector or photoelectric barrier or gate 53 for determining the position of the paddles could be interrupted during each blade revolution by means of a lever 46 with the lug 49 fastened on the shaft of the paddle wheel 27, 33. Evaluation is performed as already described via an evaluation unit 43 which is in connection with a motor-gear unit 63 which in turn displaces the drive of the paddle wheel 27, 33 by an angle of rotation alpha if there is a difference between the actual position and the set value position of the folded signature 39.

Figure 9:
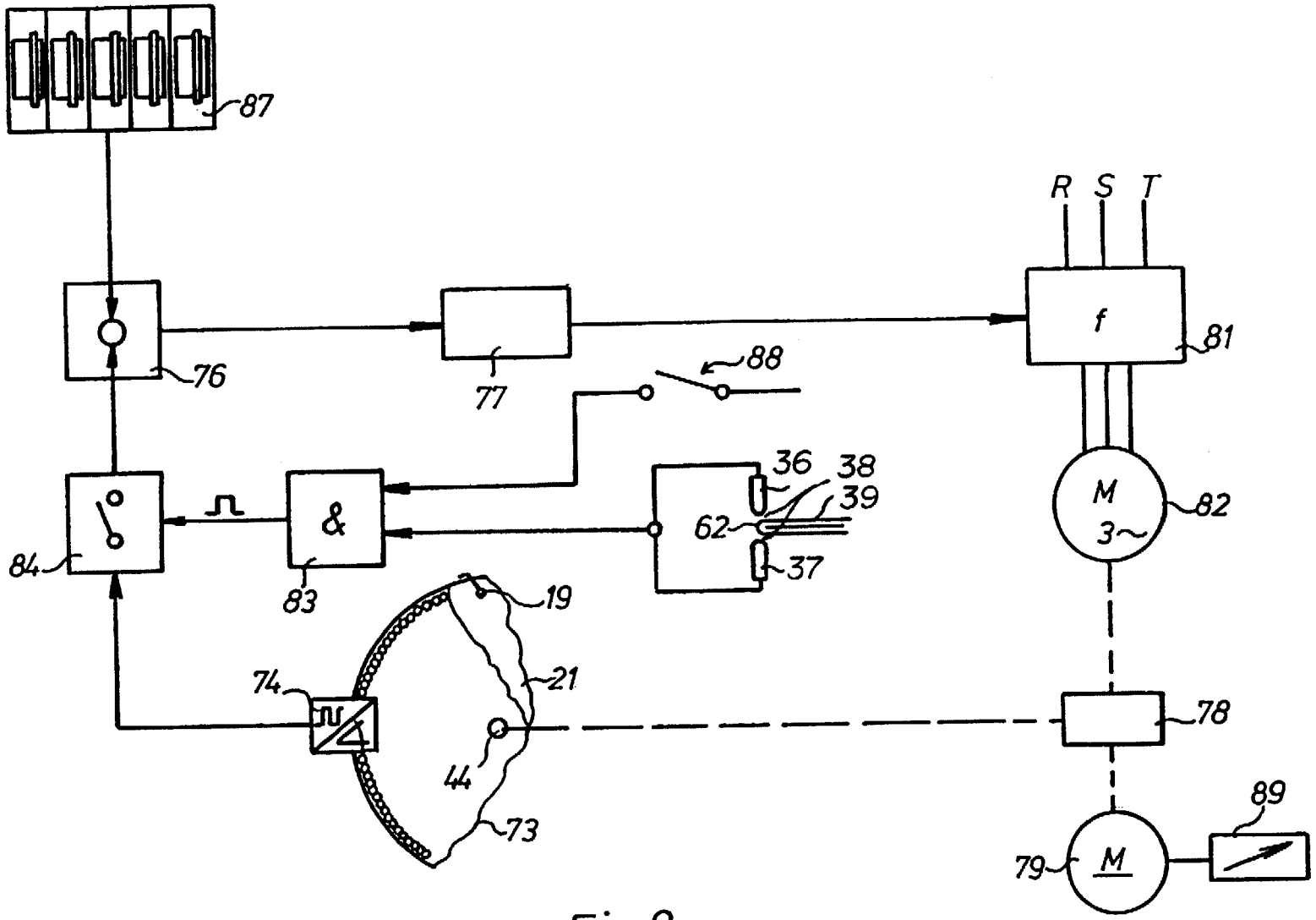

A possibility for adjusting the correctly positioned transfer of folded signatures at a gripper cylinder is represented in a further exemplary embodiment (FIG. 9).

In this process, parts 87; 73, 74; 39, 53, 83; 84; which will be described in detail subsequently, act on a difference former 76 which, at the time of the passage of the leading transverse fold edge 62 of the signature 39 through a first position detector or photoelectric barrier or gate 38 consisting of a transmitter 36 and a receiver 37 forms, a predetermined value (set value) for the length of the distance which the transverse fold edge 62 of a signature 39 must travel from the measurement reference line of the first position detector or photoelectric barrier or gate 38 to the set position of the transverse fold edge 62 in the gripper system 19. This distance is measured in degrees of angle (or pulses) of the circumferential angle of the gripper cylinder 21 by means of the angle encoder 73, 74.

In actuality, of the leading transverse fold edge 62 of the signature 39 can arrive correctly, earlier or later (measured in degrees of angle of the gripper cylinder 21) at the triggering measuring line of the first position detector or photoelectric barrier or gate 38 which triggers a switching pulse in every case. In the exemplary embodiment, this switching pulse is provided to a trigger 83, which switches a continuously counting counter 84 which switches to a zero count during each new revolution of the angle encoder 73, 74. The counter 84 receives the counting pulses from the angle encoder 73, 74. At the time of connecting the photoelectric barrier 36, 37, —in the form of pulses—the counter 84 transfers its count to a pulse difference former 76 (difference counter).

The position of the gripper system(s) 19, i.e. an imagined set position of the transverse fold edge 62 in the gripper system, is exactly assigned to several or to a defined angle(s), for example 0.0000°, 120.0000°, 240.0000° of the code disk 73. By means of this it is possible to determine at the time of the transmitted switching pulse of the photoelectric barrier 38, the exact angular position of each desired gripper system 19 and therefore the "instantaneous" distance in degrees of angle—or a number of pulses corresponding thereto—of the gripper cylinder 21 to the set position of the gripper system 19 from the measuring line of the photoelectric barrier 38, i.e. an instantaneous "actual distance". This "actual distance" is compared with a set distance—for example via the digital decade potentiometer 87, the predetermined "set distance" at the time of the passage of the leading transverse fold edge 62 of this signature 39 through the photoelectric barrier 38 (36, 37) and a switching pulse is generated by it. The set value is compared with the actual value at the time of the switching pulse and a manipulated variable is formed, which is transferred by the difference former 76 to a memory unit 77 for the purpose of correcting the angular position of the gripper cylinder 21 (in the process, the phase position of a folded signature 39 from the position or distance d—FIG. 2.1—of the leading edge of the folded signature 39 to the position of the gripper system(s) at the circumference of the gripper cylinder 21 is determined): The difference former 76 receives its set value input via a digital decade potentiometer 87. The detection of the actual position of the gripper systems 19 on the gripper cylinder 21 is performed by means of a second position detector in the form of an angle encoder 74, fixed on the side frame, which scans a code disk 73, fixed on the axle journal, and forwards this digital actual value to a counter 84. At the time of a switching pulse of the trigger 83, the pulse counter 84, which can be set to zero, forwards its value at the time of the passage of the transverse fold edge 62 to the difference former 76, but only if the press is in the "print on" position, i.e. the contact is closed. The counting unit 84 can be triggered in such a way that it measures the actual values determined by the angle encoder 74 for the position of the angle of rotation of the gripper cylinder 21 only for selected revolutions, for example for every second revolution of the gripper cylinder 21 and then sends these values to the difference former 76 further in the above described manner.

As already mentioned above, the difference former 76 determines a possible pulse difference between the number of set and actual value pulses and forwards it to the memory unit 77. For a one-time charge of the gripper cylinder 21 with positive or negative rpm for a single gripper cylinder revolution, the memory unit 77 forwards the available positive or negative difference pulses to a frequency converter 81, which drives a three-phase a.c. motor 82 accordingly. Both the three-phase a.c. motor 82 as well as the main motor 79, which can be controlled by a remote control 89, act together via a differential gear 78 on the shaft journal 44 of the gripper cylinder, which is then briefly charged with rpm which are higher or lower than the original rpm of the gripper cylinder 21, and which continues to run at the original rpm following the positive or negative rpm charge.

To summarize, the process for the correctly positioned transfer of transversely folded signatures 39, which are being conveyed from a folding jaw cylinder 11 to a following gripper cylinder 21 by means of a belt guidance system 16, 17, is executed as described below:

Selected signatures—for example every one—or every third signature—from a regular sequence of folded signatures 39, conveyed with a leading transverse fold edge 62, are used to generate a switching pulse when their transverse fold edge 62 passes through a photoelectric barrier 38, fixed in place. This means that the photoelectric barrier 38 emits an electrical pulse which can be further processed. The signatures 39 are being conveyed by means of the belt guidance system 16, 17 from a first cylinder to the following gripper cylinder 21, wherein the belt guidance system 16, 17 extends as close as possible to the circumference of the gripper cylinder 21 and is intended to make possible as tangential as possible a transfer of the signatures 39 to the gripper cylinder 21 and therefore to the gripper systems 19.

The photoelectric barrier 38 is disposed on or in the vicinity of the belt guidance system 16, 17.

The switching pulse generated by the photoelectric barrier 38 is used to trigger an instantaneous measurement of the actual angular position of the gripper systems 19 selected for taking up the signature(s).

At the time of switching through the photoelectric barrier 38 by means of the leading transverse fold edge 62, an instantaneous actual angular position of the gripper system 19 of the gripper cylinder 21 intended for taking over the preselected signature 39 is simultaneously detected and it is "prognostically" determined on the basis of both data that, for example, the signatures will arrive "too early" 93, or "in the set position" 92 or "too late" 91, provided the conditions under which the preselected signatures 39 are being conveyed are not changed in the meantime. Afterwards the "prognosed" angular position 91, 92 or 93 is compared with the set angular position 92 of the intended gripper system 19 and an electrical difference value signal of a value zero or, in case of deviations, with a positive or negative value, is formed. Subsequently the difference value signal is converted in an electronic control unit into a positive or a negative set value for a circumferential displacement of the gripper cylinder 21 in relation to the position of the fold edge 62 of the preselected folded signature 39 determined by measuring techniques. Finally, the gripper cylinder 21 is brought into the appropriate calculated set angular position 92 by drive means, for example a motor-gear unit 63 or a frequency-controlled three-phase a.c. motor 82 with a differential gear 73, so that the correctly positioned transfer of the folded signatures 39 to the gripper system 19 of the gripper cylinder 21 is assured. If the gripper cylinder 21 is displaced in a clockwise direction in its direction of rotation H, it is charged with a circulation angle displacement during one revolution in accordance with the calculated positive value, so that the gripper cylinder 21 briefly runs faster in respect to the operational rpm up to that time.

If it is necessary to displace the gripper cylinder 21 opposite to its direction of rotation H, i.e. in a counterclockwise direction, the gripper cylinder 21 is charged with a circulation angle displacement during one revolution in accordance with the calculated negative value, so that the gripper cylinder 21 briefly runs slower in respect to the operational rpm up to that time.

Beside a brief increase or decrease in the rpm of the gripper cylinder 21 for the purpose of changing the phase position of the gripper cylinder 21 in respect to the arriving signatures 39, it is also possible to appropriately change the phase position between the drive shaft or shaft journal 44 and the cylinder body of the gripper cylinder 21. This can be done in that a coupling acts between the shaft 44 of the gripper cylinder 21 and the gripper cylinder body, which is briefly disengaged for the purpose of displacing the gripper cylinder 21 in respect to the shaft 44 by means of the action of an electric motor actuating drive and in that the gripper cylinder body on the shaft 44 is appropriately displaced via an electronic gear wheel drive.

I claim:

1. An apparatus for the correctly positioned transfer of transversely folded signatures from a belt guidance system to a gripper system on a following cylinder, said transfer apparatus comprising:

a first position detector located along the belt guidance system, said first position detector being usable to detect a time of arrival of a leading fold edge of a preselected one of the signatures at a gripper system on the following cylinder;

a second position detector located adjacent the following cylinder and being usable to determine an actual angular position of a gripper system on the following cylinder intended to receive the signature whose position is being detected by said first position detector;

evaluation means for comparing said actual angular position of the gripper system with a set angular position and for generating an electrical difference value signal, said evaluation means including a difference former;

drive means for rotating the following cylinder, said drive means including a main drive motor and an auxiliary drive motor; and a differential gear mounted on a shaft journal of the following cylinder, said differential gear being connected with said main drive motor and said auxiliary drive motor, said auxiliary drive motor being connected with said difference former and being operated in response to a signal from said difference former to bring the gripper system to said set angular position.

2. The apparatus in accordance with claim 1 wherein said auxiliary drive motor is a three-phase a.c. motor which is rpm-controlled by a frequency converter.

3. The apparatus in accordance with claim 1 wherein said main drive motor is a remotely controllable d.c. motor.

* * * * *